US005227110A

United States Patent [19]

Fischer et al.

[11] Patent Number: 5,227,110

[45] Date of Patent: Jul. 13, 1993

[54] PROCESS FOR MANUFACTURING HIGHLY ORIENTED AMORPHOUS POLYESTER FILAMENT YARNS

[75] Inventors: Klaus Fischer; Halim Baris, both of Luzern, Switzerland

[73] Assignee: Viscosuisse S.A., Emmenbrücke, Switzerland

[21] Appl. No.: 707,258

[22] PCT Filed: Feb. 20, 1989

[86] PCT No.: PCT/CH89/00032

§ 371 Date: Oct. 23, 1989

§ 102(e) Date: Oct. 23, 1989

[87] PCT Pub. No.: WO89/08159

PCT Pub. Date: Sep. 8, 1989

Related U.S. Application Data

[63] Continuation of Ser. No. 432,742, Oct. 23, 1989, abandoned.

[30] Foreign Application Priority Data

Feb. 26, 1988 [CH] Switzerland ..... 724/88-4

[51] Int. Cl.[5] ..... B29C 47/88; B29C 71/00

[52] U.S. Cl. ..... 264/211.120; 264/237

[58] Field of Search ..... 264/177.17, 214, 237, 264/348, 211.12, 211.14, 210.8; 428/364, 395; 425/382.3, 404, 378.1, 378.2, 66

[56] References Cited

U.S. PATENT DOCUMENTS

| | | | |
|---|---|---|---|
| 2,322,976 | 6/1943 | Schmitz | 264/214 |
| 3,553,305 | 1/1971 | Au | 264/210.8 |
| 3,832,435 | 8/1974 | Bauer et al. | 264/210.8 |
| 4,244,907 | 1/1981 | Wu | 264/210.8 |
| 4,743,504 | 5/1988 | Carr | 264/210.8 |

FOREIGN PATENT DOCUMENTS

| | | | |
|---|---|---|---|
| 0089819 | 9/1983 | European Pat. Off. . | |
| 0224306 | 6/1987 | European Pat. Off. . | |
| 0244216 | 11/1987 | European Pat. Off. . | |
| 2155207 | 5/1972 | Fed. Rep. of Germany | 264/237 |
| 3623748 | 2/1988 | Fed. Rep. of Germany . | |
| 0776521 | 6/1957 | United Kingdom | 264/214 |

*Primary Examiner*—Leo B. Tentoni
*Attorney, Agent, or Firm*—Felfe & Lynch

[57] ABSTRACT

In a process for manufacturing fast-spin highly oriented amorphous polyester filament yarns, the shock cooling is achieved by means of a rotating cooling surface formed by the contact surface of a cooling cylinder. Filament yarns having a desired boiling shrinkage up to 70% and a birefringence larger than 0.08 can be obtained by varying the duration of contact between the filament yarns and the cooling cylinder and/or the distance between the spinneret and the cooling cylinder.

1 Claim, 3 Drawing Sheets

PROCESS FOR MANUFACTURING HIGHLY ORIENTED AMORPHOUS POLYESTER FILAMENT YARNS

This application is a continuation of application Ser. No. 07/432,742, filed Oct. 23, 1989, now abandoned.

FIELD OF THE INVENTION

The invention concerns a method for the production of highly oriented amorphous polyester filament yarns by means of melt spinning with winding speeds of >4000 m/min, as well as an apparatus for the implementation of the method.

BACKGROUND OF THE INVENTION

The production of a fast spun polyester filament yarn consisting of at least 85 weight % of ethyleneterephthalate units, leads to a feeder-yarn which, because of its highly oriented amorphous qualities, is eminently suitable for false twist texturing. However, these properties can only be obtained if fast cooling can be effected at high winding up speeds.

Basically, two different methods were proposed to obtain such a shock cooling process.

Thus EP-A-O 089 819 describes a shock cooling process by means of water. In this process, a polyethyleneterephthalate filament yarn is cooled in a water bath at a rate of at least 5000 m/min. While being highly oriented, the resultant yarn only has a low crystallinity, substantiated by a boiling shrinkage of at least 45% and at most 68.5%.

However, cooling in water has serious drawbacks. First of all, the yarn is subjected to breaking in the water bath, resulting in high stresses. There occur problems with spraying water and the application of a spinning preparation onto the wet yarn. When using water cooling, there occurs a rapid increase in the water carried along adhering to the surface, and hence in the spraying water, as the number of filaments increases.

As compared with shock cooling with water, an improvement has been obtained with air cooling. Thus EP-A-O 244 216 describes a polyester filament yarn which is spun at a rate of over 5000 m/min in a high pressure chamber where a narrow tube is arranged at its outlet, shock cooling being obtained because of the Venturi effect. In the case of air cooling, the uniform cooling of the gathered filament bundle in the cooling tube (Venturi) is no longer ensured as the number of filaments increases.

Apart from the drawback of the high specific air consumption of up to approximately 70 $Nm^3/kg$ of polyethyleneterephthalate, it is not possible to ensure a defined yarn speed in the range below the spinneret, exactly at the point where the most intensive cooling must be effected.

Objects of the Invention

It is the object of the invention to provide a method for the shock cooling of a fast spun polyethyleneterephthalate filament yarn, which ensures a defined yarn speed in the cooling range.

A further object is to make available an apparatus for implementing the above mentioned method.

Another object is to make available a polyester filament yarn with a high birefringence and a relatively high boiling shrinkage as a feeder yarn.

Other objects and advantages of the invention will become apparent as the description thereof proceeds.

DESCRIPTION OF THE INVENTION

The solution of the problem lies in a method which, is characterized in that the melt spun filament yarns are cooled by means of a rotating contact surface, and that they are subsequently provided with a spinning preparation and wound up.

A rotating contact surface has the advantage that an operation becomes possible under more defined conditions without a liquid or gaseous medium. Irrespectively thereof, it is possible to determine the cooling rate by determining the distance of the cooling surface from the spinneret and the angle of contact of the yarn on the cooling surface.

Merely by varying the two parameters, it is possible to obtain a great number of yarn properties.

It has proved to be expedient to choose the contact times of the filament yarn on the contact surface between $1\times10^{-3}$ and $1\times10^{-2}$s, in particular $2\times10^{-3}-6\times10^{-3}$s, set with a range of the peripheral speed of the contact surface between 1600 to 2400 m/min. It is, of course, also possible to calculate the contact length or the angle of contact of the filament yarn from the specification of the time.

The polyester yarn produced in accordance with the method, surprisingly has an undeformed circular cross section without coalescences. The birefringence values lie, depending on the setting, between 0.08 and 0.11 and at the same time, a boiling shrinkage of >40% in particular between 40–70%, preferably at 45–60% with reference to the non-shrunk filament yarn.

A rotating contact surface used as the cooling surface has proved suitable as the apparatus for implementing the method.

A rotating contact surface has the advantage that it is possible to cool a greater number of single filaments than was possible in the known shock cooling processes. Thus it is readily possible to cool 30 and more filaments simultaneously. The desired properties of the high shrinkage yarn (40–70% BS) can be obtained in a particularly simple way by varying the distance from the spinneret, as well as the circulating speed of the contact surface.

According to a preferred mode of embodiment, the contact surface is designed as cooling roller. The cooling roller is preferably a hollow body made of a material with good thermal conductivity and can be provided with additional connections for a heat transfer medium or a cooling medium. Such a roller ensures a freely selectable heat removal for the polyester filament yarns.

A cooling belt is also suitable for the shock cooling of polyester filament yarns, the thickness of which depends on the flexibility of the belt.

The contact surface expediently consists of a material with a good thermal conductivity, preferably a metal or alloy. Copper, aluminum and their alloys are particularly suitable.

The thickness of the metal layer amounts to 2–100 mm, preferably 10–80 mm, in particular 40–60 mm. The distance of the cooling roller from the spinneret amounts to 250–1000 mm, depending on the filament titre and overall titre.

The invention will be described in greater detail with reference to the drawings.

BRIEF DESCRIPTION OF THE DRAWINGS

There are shown in.

Figure 1:
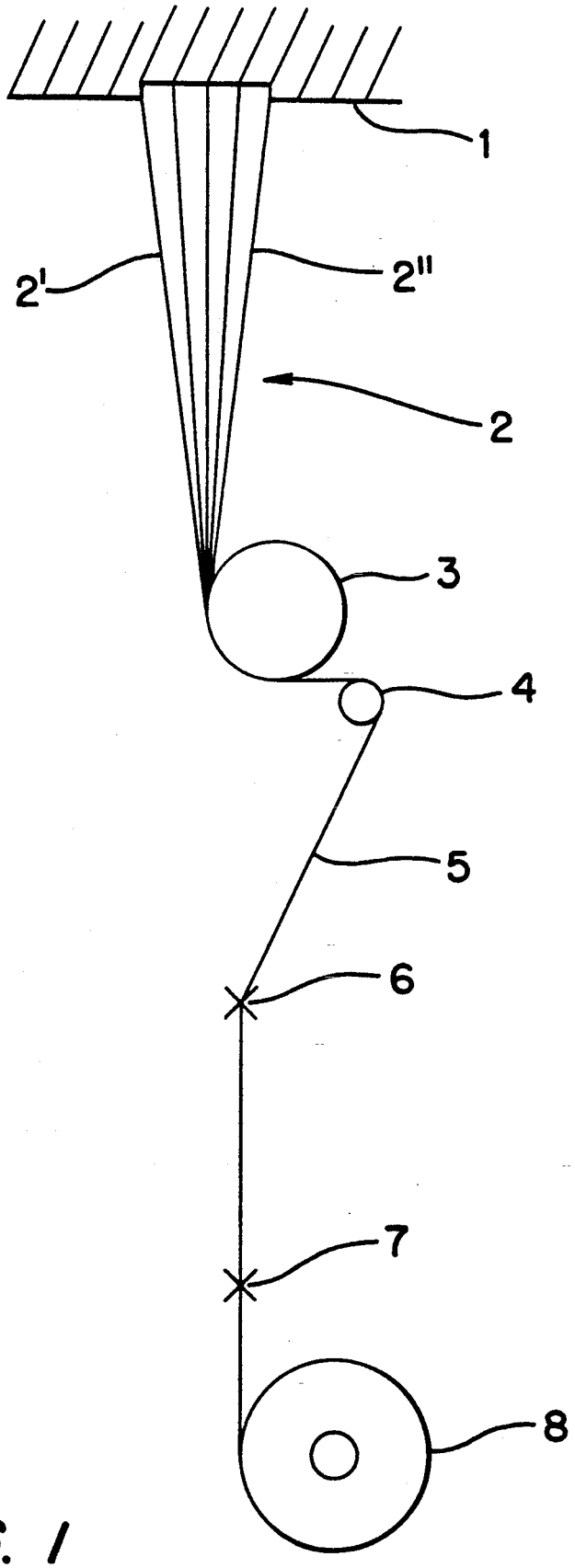
FIG. 1, a schematic representation of the method in accordance with the invention with a cooling roller.

According to FIG. 1, a spinneret is designated by 1. From the spinneret, there emerges a bundle of polyester yarn filaments 2, whose outer filaments are designated by 2' and 2" respectively. Provision is made for a cooling roller 3 between a guide roller 4 and the spinneret 1. A resultant combined yarn 5 runs over a convergence point 6 where a spinning preparation is applied in the known way. Provision can be made for an additional entangling device 7 ahead of a winding device 8.

Figure 2:
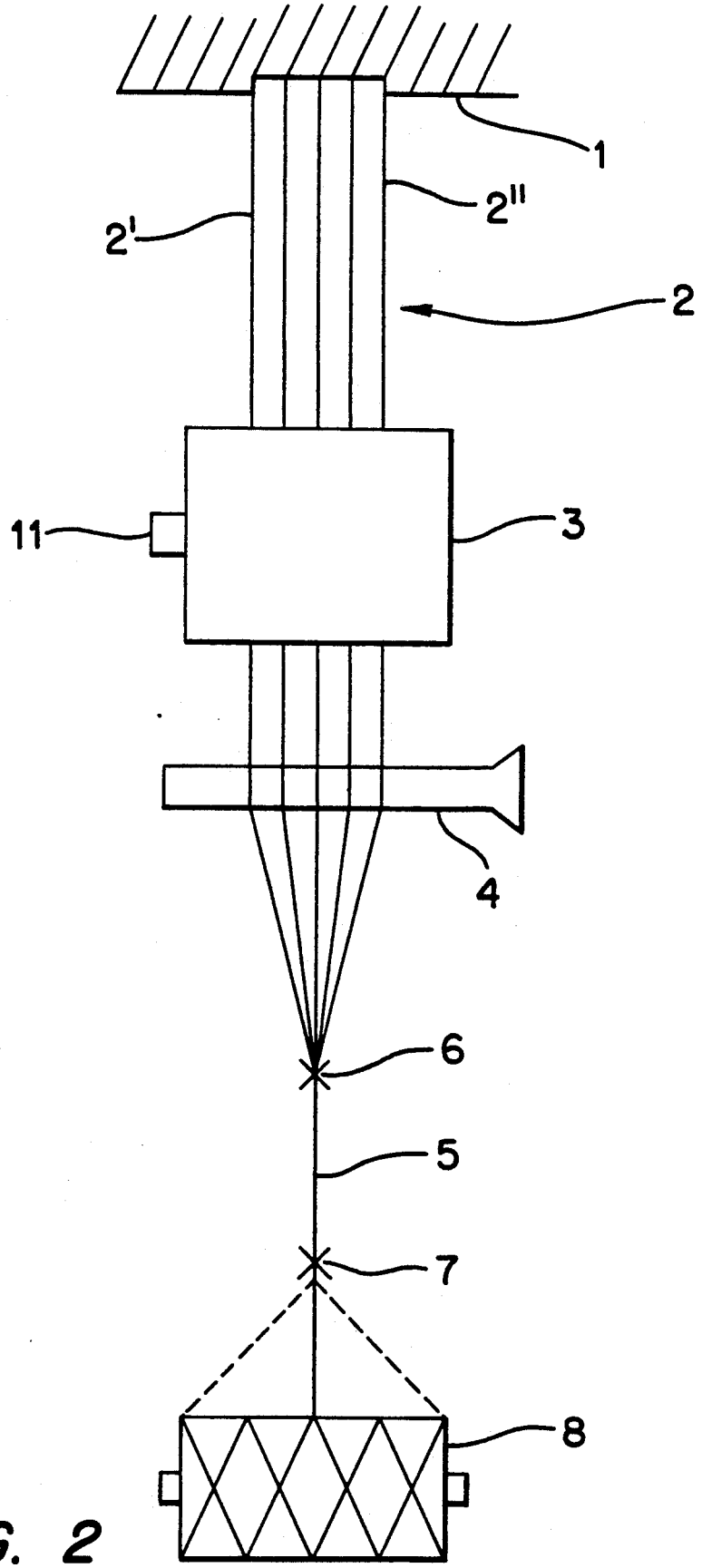
FIG. 2, a view according to FIG. 1 rotated by 90°.

In FIG. 2, the arrangement of FIG. 1 is shown rotated by 90°. Apart from the components of the apparatus of FIG. 1, there are indicated the connections 11 for a heat transfer medium. The purpose of the representation is to illustrate the progress of the single filaments as far as the convergence point 6. The number of the yarn filaments 2 is largely non-critical.

Figure 3:
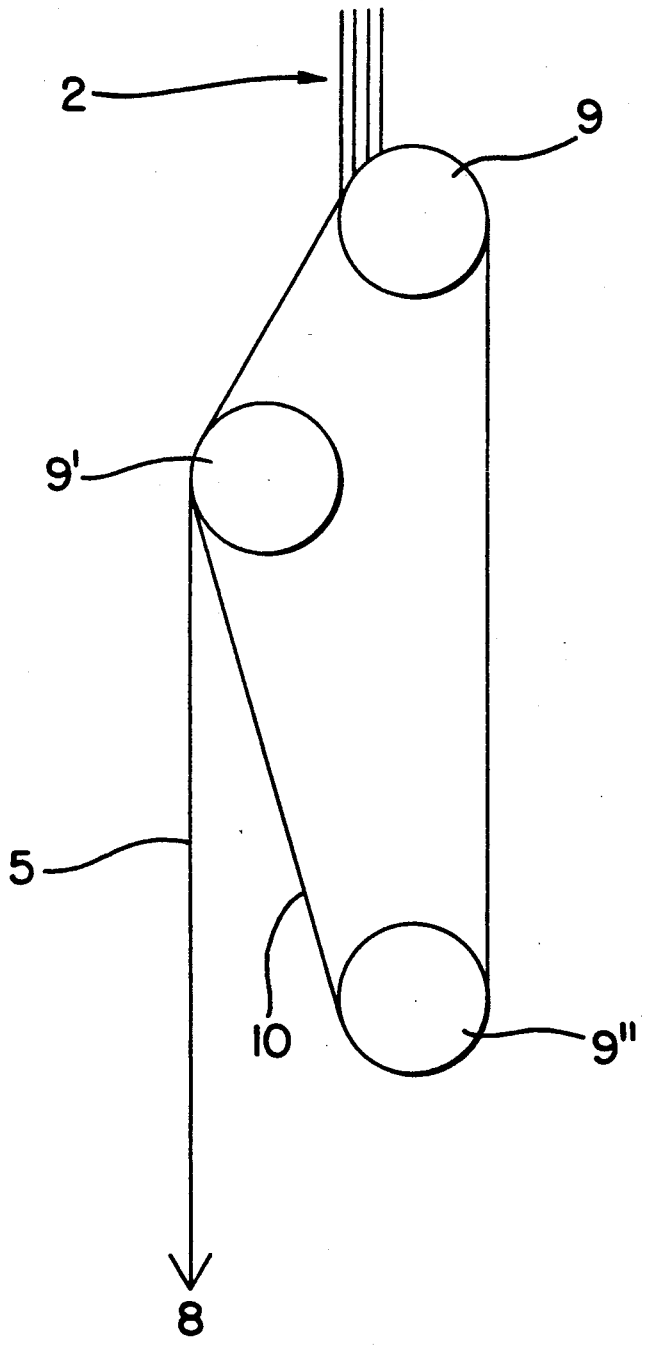
FIG. 3, a schematic representation of a cooling belt.

FIG. 3 shows a cooling belt 10 which is carried over rollers 9, 9' and 9", at least one of these rollers being driven by means of a motor, not shown. The yarn filament bundle 2 arrives at the cooling belt 10 in the region of the roller 9 and leaves the cooling belt 10 in the region of the roller 9' as the combined yarn 5, towards the winding device 8, not shown.

In operation, a polyester yarn filament bundle 2 emerging from the spinneret 1 arrives on the surface of the cooling roller 3 where it experiences shock cooling during its contact with the roller surface. In this process, the cooling roller 3 is revolving at a peripheral speed of 1600 to 2400 m/min. The yarn is fed to the winding device 8 via the guide roller 4 and via the convergence point 6 with a winding up speed of at least 4000 m/min. A possible stretching is determined by the difference between the winding up speed and that of the cooling roller 3.

If required, the action of the cooling roller can be enhanced by heat removal by means of a cooling medium.

EXAMPLES OF APPLICATIONS

Test Parameters

A standard polyester polymer with an intrinsic viscosity of 0.75 dl/g was spun without godet rollers at a constant winding up speed of 5000 m/min to the two titres dtex 67 f 12 and 200 f 30 (nom. 55 dtex f 12 and 167 f 30).

The following parameters were varied:

| | |
|---|---|
| the spinneret/roller distance | 35–100 cm |
| the roller speed | 1400–2400 m/min |
| the yarn contact length on the roller | 12–16 cm |

Execution of the Tests

Instead of the crystallinity, the boiling shrinkage (BS) has been indicated. The boiling shrinkage was determined by a length measurement before and after a heat treatment in water [BS measurement: a single filament, 50 cm in length (unshrunk): at 98° C.± 1° C. in water for 2.5 minutes: mean value from 3 measurements]. With an approximately similar orientation of the yarns, the value of the boiling shrinkage may be considered as a comparative measurement of the crystallinity substantiated by density measurements of the filaments. By means of the results of these measurements, the optimum spinneret cooling-roller distance was determined for the respective spinning titre and the properties required for it. It is possible to influence the spinning result by the spinneret cooling roller distance, the peripheral speed of the cooling roller and the filament cooling roller contact length (this corresponds to the cooling time). At a constant peripheral speed of the cooling roller and a constant contact length of the yarn on its surface, it is, above all, the boiling shrinkage that is affected by the spinneret cooling roller distance whilst the orientation does not show any clear cut tendency. The test results are represented in tables. From Table 1, it may be gathered that with an increasing distance, the BS is subjected at first to a slight decline and when a limit is reached, in the case described, approximately 55–60 cm, suddenly to a very pronounced decline.

TABLE 1

| | | | | | | | | | |
|---|---|---|---|---|---|---|---|---|---|
| Peripheral cooling roller speed | 2000 m/min | | | | | | | | |
| Yarn contact length on the cooling roller | 16 cm = contact time: 4.8 ms | | | | | | | | |
| Spinning titre | 67 f 12 dtex | | | | | | | | |
| Winding up speed | 5000 m/min | | | | | | | | |
| Distance spinneret cooling roller [cm] | 30 | 35 | 40 | 45 | 50 | 55 | 60 | 65 | 70 |
| Boiling shrinkage [%] | 66.3 | 67.0 | 67.0 | 71 | 68 | 66 | 62 | 19.6 | 4 |
| Birefringence × $10^3$ | 88.1 | 91.6 | 92.5 | 83.1 | 84 | 87.5 | 81.1 | 88.2 | 91.6 |

By means of the variable angle of contact of the filament on the cooling roller periphery, it is possible to vary the contact time and hence the cooling time. By means of this parameter, the BS of the spun yarns is also basically influenced. As the cooling time i.e. the contact length, is shortened, there appear, as shown in Table 2, the same trends in the relationships depending on the spinneret cooling roller distance, only at a lower level.

TABLE 2

| | | | | | | |
|---|---|---|---|---|---|---|
| Peripheral cooling roller speed | 2000 m/min | | | | | |
| Yarn contact length on the cooling roller | 12 cm = contact time: 3.6 ms | | | | | |
| Spinning titre | 67 f 12 dtex | | | | | |
| Winding up speed | 5000 m/min | | | | | |
| Distance spinneret cooling roller [cm] | 30 | 35 | 40 | 45 | 55 | 65 |
| Boiling shrinkage [%] | 58.0 | 56.6 | 54.0 | 56.6 | 49.0 | 8.3 |
| Birefringence × $10^3$ | 87.9 | 77.6 | 88.1 | 81.1 | 97.0 | 90.2 |

In contrast to the adjustment values of the cooling roller already referred to, where by altering them, it proved impossible to exert a clear cut influence on the orientation in a given direction, the orientation of the spun yarn can be set within certain limits by means of the roller speed. As shown in Table 3, with an increasing speed the boiling shrinkage increases simultaneously, the increase below 2000 m/min being pronounced and above this value being only slight, with a contrary trend in the orientation (birefringence).

TABLE 3

| | | | | | |
|---|---|---|---|---|---|
| Spinneret cooling roller distance | | 45 cm | | | |
| Contact length | | 12 cm = contact time: 3–4.5 ms (depending on the cooling roller speed) | | | |
| Spinning titre | | 67 f 12 dtex | | | |
| Winding up speed | | 5000 m/min | | | |
| Roller speed [m/min] | 1600 | 1800 | 2000 | 2200 | 2400 |
| Boiling shrinkage [%] | 21.0 | 32.0 | 56.6 | 62.0 | 66.0 |
| Birefringence $\times 10^3$ | 96.9 | 91.9 | 88.1 | 84.1 | 78.9 |

In spinning to the titre dtex 200 f 30 (nom. dtex 167 f 30) —a higher filament titre and greater number of filaments—the spinneret cooling roller distance must be increased to approximately 80 cm because of the slowed down cooling ahead of the cooling roller in order to obtain a boiling shrinkage of >40%. Basically, however, the relationships ascertained for the dtex 67 f 12 titre are preserved, as may be seen from the example of the cooling roller speed from Table 4.

TABLE 4

| | | | | |
|---|---|---|---|---|
| Cooling roller speed [m/min] | 1600 | 1800 | 1900 | 2000 |
| Boiling shrinkage [%] | 32.0 | 44.0 | 53.0 | 57.0 |
| Birefringence $\times 10^3$ | 103.5 | 102 | 99.5 | 96.0 |

A particular advantage of the method in accordance with the invention is seen in the fact that, in contrast to the known cooling processes with water or air, the yarn properties can be specifically affected. In addition, the method in accordance with the invention operates more economically, since it is neither necessary to make provision for an air cooling installation and its expensive operation, nor for preventive measures for incidental fouling by spraying water in wet operations.

DESIGNATIONS

| | |
|---|---|
| 1 | Spinneret |
| 2,2',2" | Filaments |
| 3 | Cooling roller |
| 4 | Guide roller |
| 5 | Combined yarn |
| 6 | Convergence point/spinning preparation |
| 7 | Swirling |
| 8 | Winding up device |
| 9,9',9" | Rollers |
| 10 | Cooling band |
| 11 | Pipe connection |

We claim:

1. The method of producing a highly oriented amorphous polyester filament feeder yarn for false twist texturing having a boiling shrinkage of 40 to 70%, which comprises melt-spinning a polyester in a spinneret into yarn filaments, shock-cooling the melt-spun yarn filaments by bringing them in contact with a cooled rotating surface at a distance of 35 to 60 cm from the spinneret for $1\times10^{-3}$ to $1\times10^{-2}$ seconds, and winding the yarn on a bobbin at a speed of more than 4500 m/min.

* * * * *